US007581361B1

(12) United States Patent
Murkland

(10) Patent No.: US 7,581,361 B1
(45) Date of Patent: Sep. 1, 2009

(54) PLUG FOR TEMPORARILY BUT SECURELY COVERING HOLES IN FLOOR- OR DECK-TYPE BUILDING STRUCTURES

(76) Inventor: Brian W. Murkland, 71 Estabrook St., Grafton, MA (US) 01519

( * ) Notice: Subject to any disclaimer, the term of this patent is extended or adjusted under 35 U.S.C. 154(b) by 1276 days.

(21) Appl. No.: 10/351,984

(22) Filed: Jan. 27, 2003

Related U.S. Application Data

(60) Provisional application No. 60/352,421, filed on Jan. 28, 2002.

(51) Int. Cl.
*E02D 19/00* (2006.01)

(52) U.S. Cl. ..... 52/169.5; 52/301; 52/300; 52/21; 220/800

(58) Field of Classification Search ..... 52/169.5, 52/301, 300, 19, 21; 220/307, 787, 800, 220/801, 802; 256/66, 65.01; 215/355; D8/386, D8/349, 499; 411/496, 509
See application file for complete search history.

(56) References Cited

U.S. PATENT DOCUMENTS 3,412,437 A * 11/1968 Bennett ..... 411/509
4,262,701 A * 4/1981 Beacom ..... 138/89
4,301,629 A 11/1981 Farr
D273,091 S * 3/1984 Kurosaki ..... D8/499
4,712,343 A 12/1987 Dearing et al.
4,807,415 A 2/1989 Oak
4,823,978 A * 4/1989 Pufpaff ..... 220/787
4,890,425 A * 1/1990 Mamula ..... 52/19
5,046,223 A * 9/1991 Kraus ..... 24/453
5,103,615 A 4/1992 Owens
5,499,737 A * 3/1996 Kraus ..... 220/787
5,503,181 A 4/1996 Kennedy
6,745,530 B2 * 6/2004 Nesbitt ..... 52/301

* cited by examiner

*Primary Examiner*—Basil Katcheves
(74) *Attorney, Agent, or Firm*—Bldogett & Bldogett, P.C.

(57) ABSTRACT

A plug which covers and protects a hole which has been drilled in a concrete floor in a commercial building. The plug has a head that is larger than the hole and a base having a cross-sectional dimension that is approximately equal to the cross-sectional dimension of the hole. The plug protects the hole and keeps things from falling through the hole between the time that the hole is drilled and the hole is filled with pipes, wiring, and sealant.

11 Claims, 5 Drawing Sheets

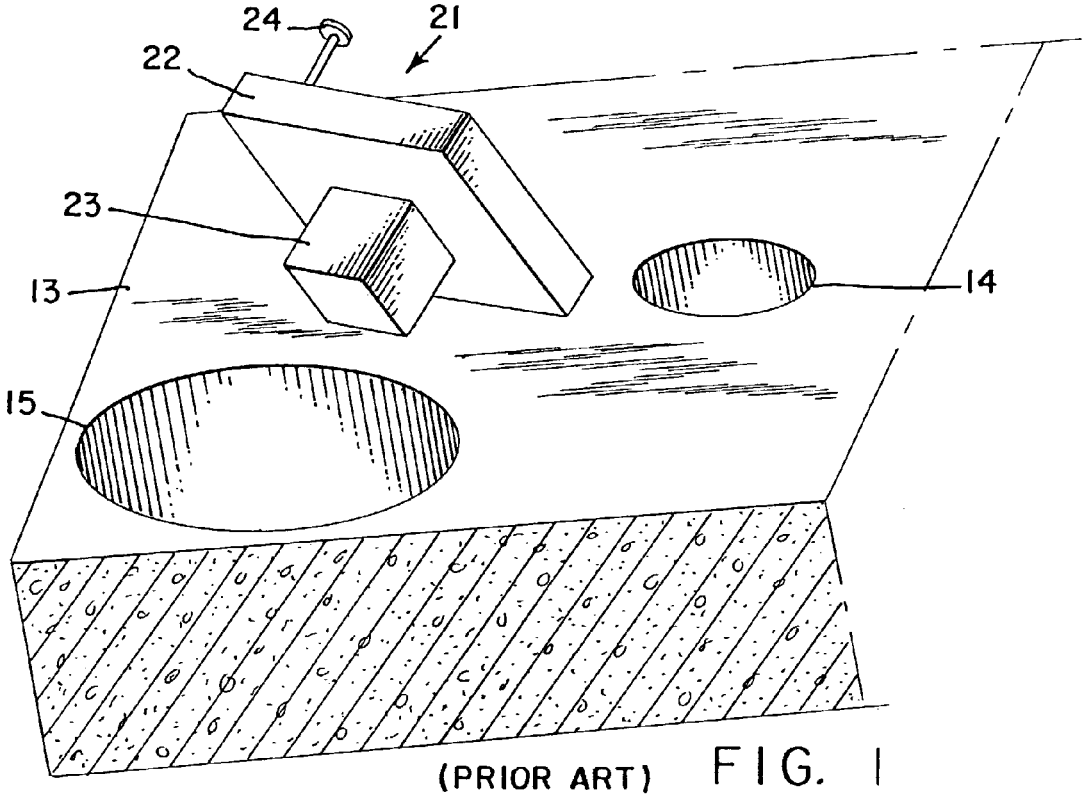
(PRIOR ART) FIG. 1
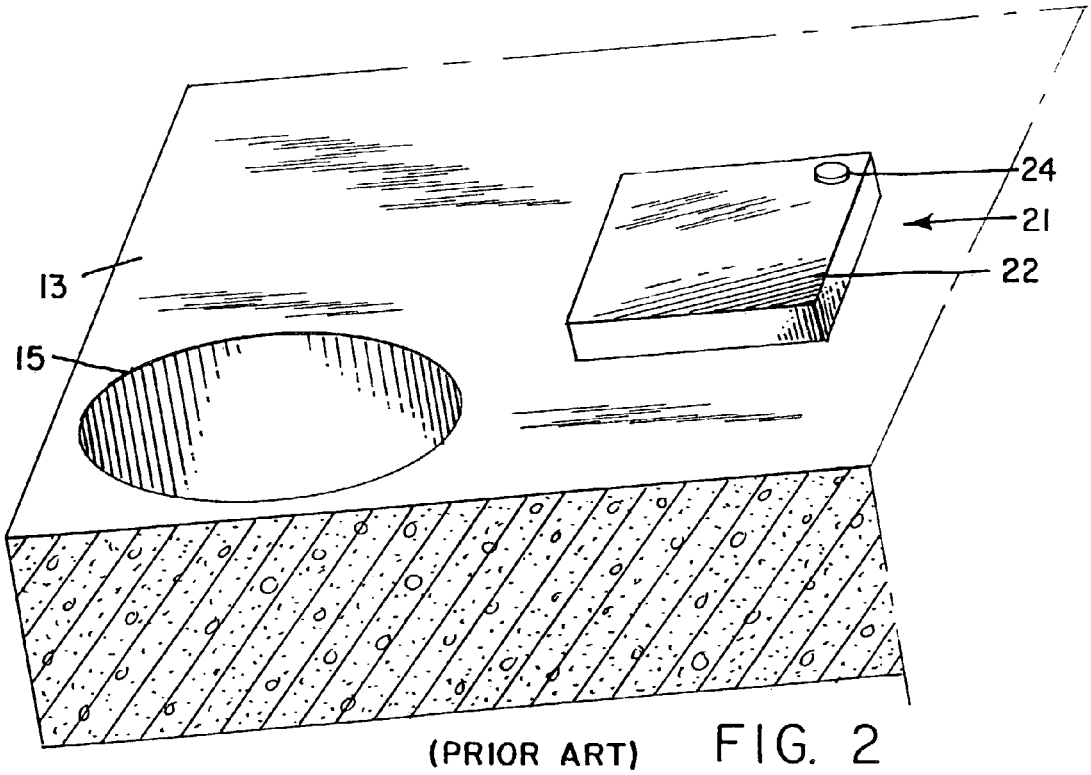
(PRIOR ART) FIG. 2

PLUG FOR TEMPORARILY BUT SECURELY COVERING HOLES IN FLOOR- OR DECK-TYPE BUILDING STRUCTURES

CROSS-REFERENCE TO RELATED APPLICATIONS

This application claims the benefit under 35 U.S.C. §119 (e) of prior U.S. Provisional Application No. 60/352,421 filed Jan. 28, 2002; which is hereby incorporated by reference.

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

This invention is a solution to a safety problem (which is the subject of OSHA regulations) in the commercial construction industry. It is a system which covers and protects a hole which has been drilled in a concrete floor in a commercial building. The system protects the hole and keeps things from falling through the hole between the time that the hole is drilled and the hole is filled with pipes, wiring, and sealant.

In commercial construction, it is normal practice for special tradesman to bore numerous holes through concrete floors in the various stories of the building. The purpose of the holes is to allow passage of pipes and wiring through the holes. Normally, the hole drillers go through and drill their holes and then it may be some time before the appropriate tradesman comes by to use the holes to pass pipes and wires through the floors. In the meantime, unless the area is cordoned off, people walking around can stumble or fall as a result of the presence of the holes or can drop things through the holes which could injure people below. As a result, the existence of the these holes poses a serious safety hazard. As a result, the Occupational Health and Safety Administration (OSHA) has issued regulations that require that these interim holes be covered in a fairly specific way.

The conventional way of satisfying this regulation is to cut up a series of rectangular pieces of plywood, attach a rectangular piece of plywood on the underside, and then place the resulting structure in the hole and use a concrete nail through the top to fasten the resulting plywood structure in the hole. This standard practice has a number of drawbacks. First of all, it is expensive and complicated to produce these products at the work site especially under union work rules. In order to make the plywood strong enough, it has to relatively thick and it is very common for people walking around the work site to trip over the devices or pop them out of the holes. Although the concrete nails are intended to keep the devices in the holes, the nails often are not driven down and cause people to trip over them or are caught by hoses that are being pulled across the site. Furthermore, the use of concrete nails often chips off chunks of the concrete around the holes and interferes with proper sealing of the holes when they are to be actually used. Furthermore, pieces of concrete fall through the holes and create additional hazard.

These and other difficulties experienced with the prior art devices and processes have been obviated in a novel manner by the present invention.

It is, therefore, an outstanding object of the present invention to provide a system which covers and protects a hole which has been drilled in a concrete floor in a commercial building.

Another object of this invention is to provide a system that protects the hole and keeps things from falling through the hole between the time that the hole is drilled and the hole is filled with pipes, wiring, and sealant.

A further object of the present invention is to provide a plug which is simple to install.

It is another object of the invention is to provide a plug that is simple and easy to extract.

A still further object of the invention is to provide a plug that can be reused.

It is a further object of the invention to provide a plug that will not accidently extract under reasonable conditions.

It is a further object of the invention to provide a plug that presents a very low obstacle profile and geometry.

It is a further object of the invention to provide a plug which is capable of being manufactured of high quality and at a low cost, and which is capable of providing a long and useful life with a minimum of maintenance.

With these and other objects in view, as will be apparent to those skilled in the art, the invention resides in the combination of parts set forth in the specification and covered by the claims appended hereto, it being understood that changes in the precise embodiment of the invention herein disclosed may be made within the scope of what is claimed without departing from the spirit of the invention.

BRIEF SUMMARY OF THE INVENTION

This invention is a plug which covers and protects a hole which has been drilled in a concrete floor in a commercial building. The plug protects the hole and keeps things from falling through the hole between the time that the hole is drilled and the hole is filled with pipes, wiring, and sealant.

The present invention is essentially a mushroom shaped plug made up of strong plastic. It protects the hole and keeps things from falling through the hole between the time that the hole is drilled and the hole is filled with pipes, wiring, and sealant. The head of the plug is thin but large enough to cover up the hole opening and extend beyond its periphery. The underside of the head has slots for prying up the plug. The base of the plug has multiple vanes (typically four) which are pushed into the hole and engage the bore of the hole to hold the plug in place. Because the head of the plug is relatively thin, it provides a very minimal obstruction on the floor and is very unlikely to be dislodged by hoses or other equipment moving around. On the other hand, the flange is thick enough so that it can support the weight necessary to qualify under the OSHA regulations. The base is sufficiently strong and sufficiently snug that it holds the plug in place unless it is intentionally pried up. It does so without doing any damage to the edges of the hole.

As can be seen in the drawings, this device looks like a mushroom with a thin head and base.

The plugs would be sized to protect the standard plug-cut holes of 2, 3, 4, 5, 6, 7, 8, 9, 10, 11, and 12 inch diameter (nominal), which holes are, in fact, slightly oversized. The plug would be preferably made of polypropylene, but could also be made of polyethylene, polystyrene, polyester, or polyvinyl chloride (PVC).

BRIEF DESCRIPTION OF THE DRAWINGS

The invention can be best understood by reference to the drawing, in which:

FIG. 1 is a perspective view showing a prior art plug system involving an opening, hole, or bore in the surface of a construction base and a plug lying on the surface;

FIG. 2 is similar to FIG. 1 showing the prior art plug in the hole;

DETAILED DESCRIPTION OF THE INVENTION

Figure 3:
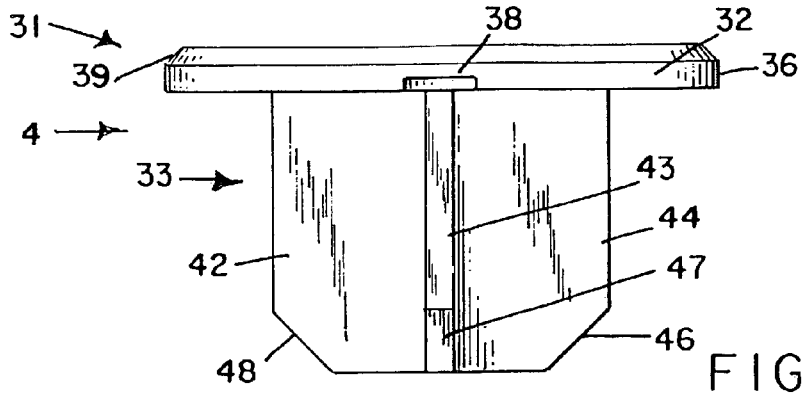
FIG. 3 is a side elevational view of a plug embodying the principles of the present invention.

FIG. 1 shows a block 13 of material which represents the concrete for a commercial construction project. Block 13 has two bores, 14 and 15. Bore 14 is two inches in diameter and bore 15 is four inches in diameter. Shown sitting on the top surface of the block 13 is a prior art cover, generally indicated by the reference numeral 21. The prior art cover 21 is designed to comply with workplace safety regulations. The cover 21 consists of the large particular plywood plate 22 whose upper surface is colored in a bright color and which bears the word "hole". On the lower surface of the plate is mounted a rectangular block 23. In the conventional use, situation begins with the drilling of a large number of bores in the concrete floor of the construction of a commercial building. In the prior practice, the above mentioned wooden cover 21 would the placed with the plate 22 over the hole and the block 23 positioned in the hole. FIG. 2 shows the prior part cover 21 in position in the two inch diameter hole. In order to achieve the necessary strength, the plywood plate must the reasonably thick so that it arises well above the surface of the floor and presents edges which are perpendicular to the floor and thereby present a significant obstacle. The effective diameter of the block 23 would be much smaller than the diameter of the hole. Furthermore, the block 23 would normally be less than an inch long and much shorter than the diameter of the holes. The block 23 would, to some extent, keep the cover 22 from sliding around on the floor. A concrete nail 24 is driven through the plate and into the concrete floor adjacent the hole for keeping the cover in place. However, for reasons described above, the prior art cover tends to be an obstacle and tends to not function well. Furthermore, it tends to damage the concrete floor and often damages the edge of the hole it is supposed to protect.

Figure 4:
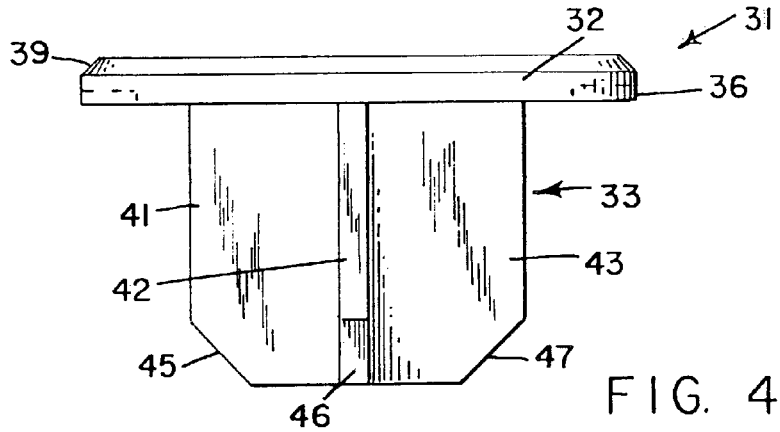
FIG. 4 is a side elevational view of the plug of FIG. 3 looking in the direction to arrow 4 in FIG. 3.
Figure 5:
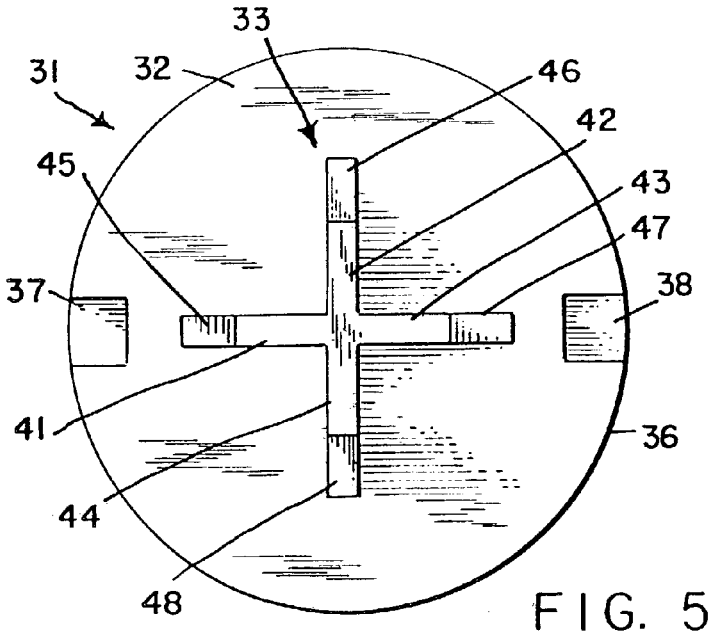
FIG. 5 is a bottom plan view of the plug.
Figure 6:
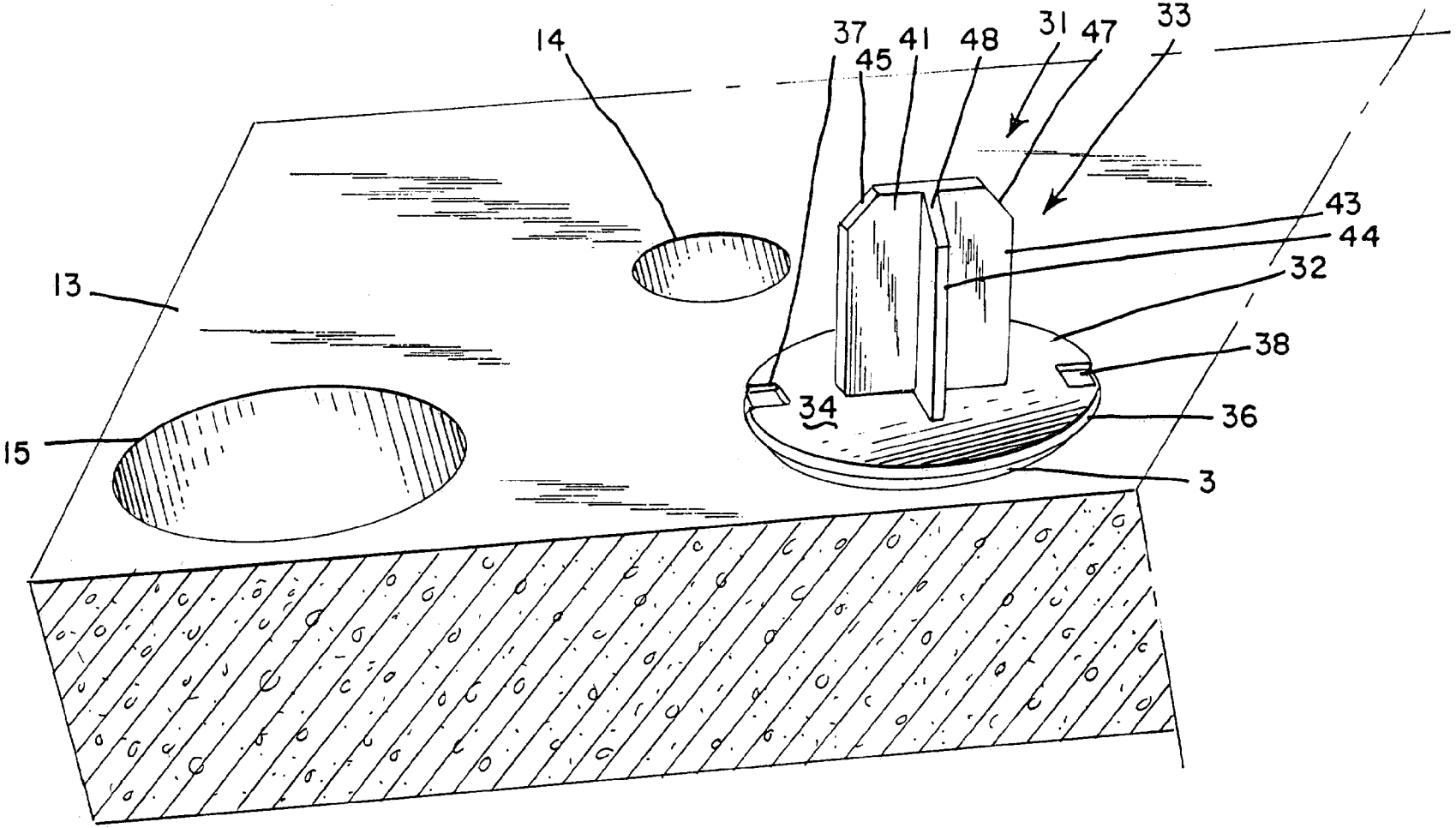
FIG. 6 is a perspective view of the plug of the present invention shown on the surface of a construction base having a hole in the surface.

Referring to FIGS. 3-5, the plug of the present invention is generally indicated by the reference numeral 31. The plug 31 includes a circular head portion 32 and a base, generally indicated by the reference numeral 33, formed on the lower surface 34 of the head portion a base portion, generally indicated by the reference numeral 33. The base portion 33 has a cruciform shape in horizontal cross-section and comprises two pairs of diametrically opposed vanes. The first pair of vanes 41 and 43 are opposed. The second pair of vanes 42 and 44 are opposed and perpendicular to the first pair of vanes 41 and 43. Each vane has a vertical outer edge surface that extends downwardly from the lower surface 34 and a tapered outer edge surface that extends downwardly and inwardly from the lower edge of the outer edge surface.

The plug 31 is preferably made of polypropylene but can be made of any thermoplastic material such as polyethylene, polystyrene, polyester or polyvinyl chloride (PVC). The dimension between the outer vertical edges of each pair of diametrically opposed pairs of vanes is normally greater than the diameter of the hole for which the plug is designed. For example, for a hole having a diameter D, the dimension between the vertical side edges of two opposed vanes is at least D plus 1/32 inch. The material of the plug is sufficiently compressible to enable the base of the plug to be inserted into the hole in a force fit. This maintains the plug in the hole snugly and yet allows the plug to be removed. Ideally, the plug of the present invention is made in a plurality of sizes for holes of different sizes. The plugs of the present invention are adapted for holes ranging from 2" to 12" in diameter in increments of 1". For each size of plug, the horizontal dimension of each pair of vanes is at least 1/32" greater than the diameter of the hole and the diameter of the head 32 is greater than the diameter of the hole, for example, 2" greater than the diameter of the hole so that there is a one inch overlap from the edge of the hole.

Figure 7:
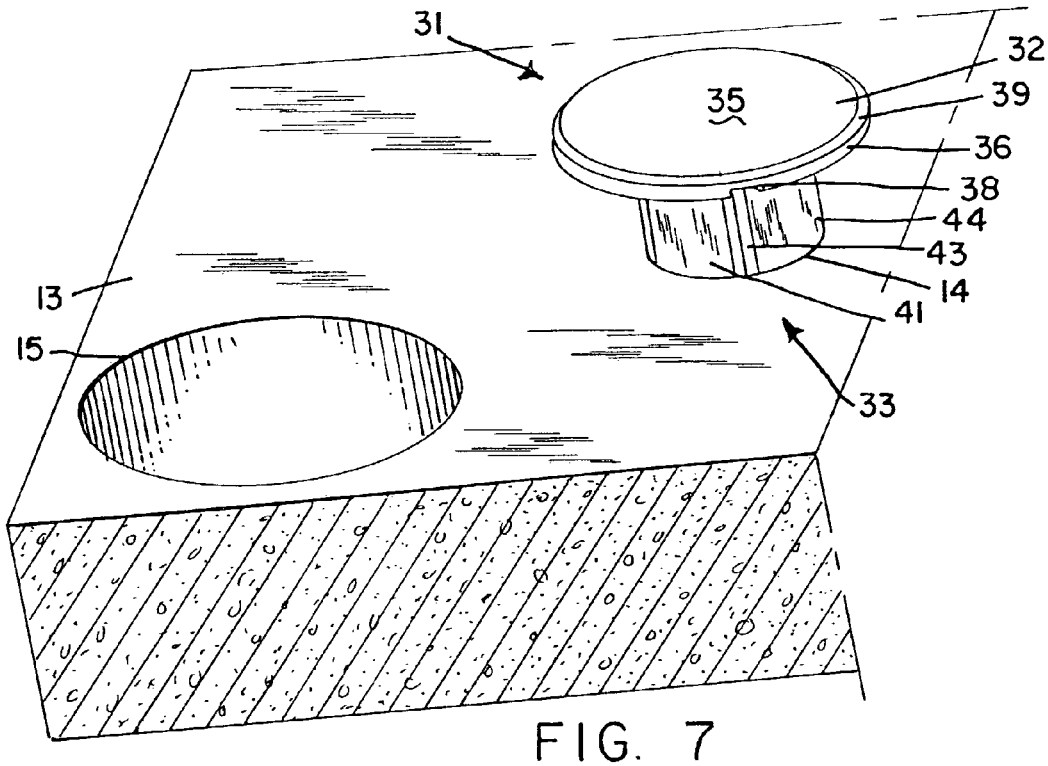
FIG. 7 is a view similar to FIG. 6 showing the plug partially inserted in the hole.
Figure 8:
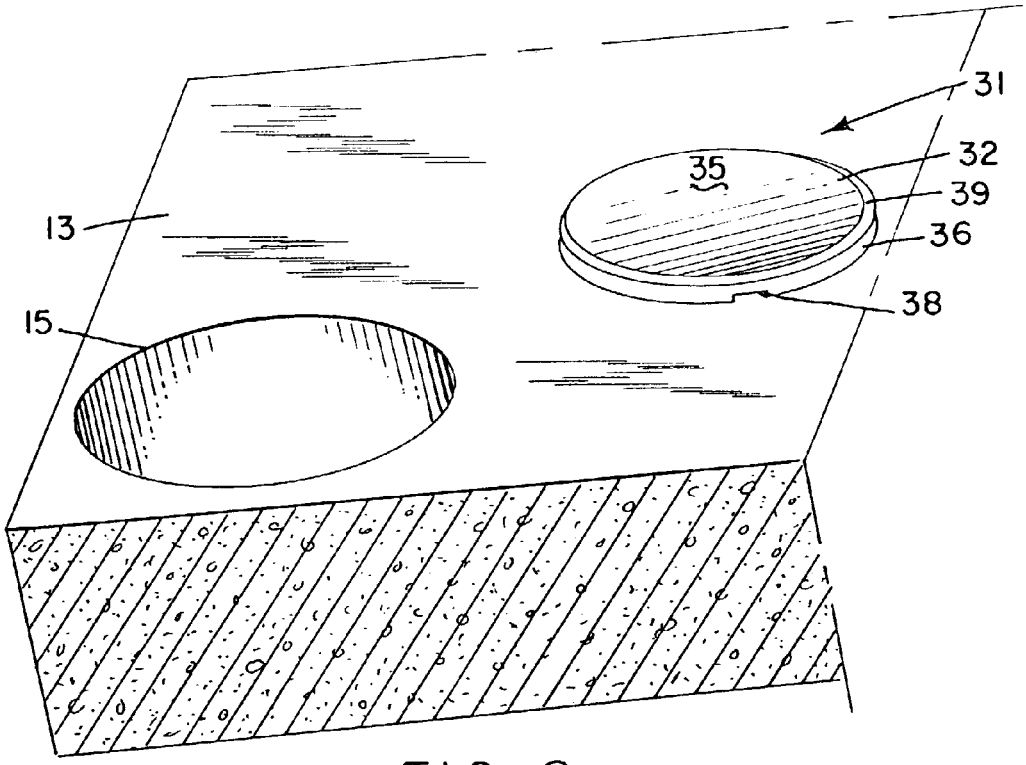
FIG. 8 is a view similar to FIG. 7, showing the plug fully inserted in the hole to constitute a plug system embodying the principles of the present invention.
Figure 9:
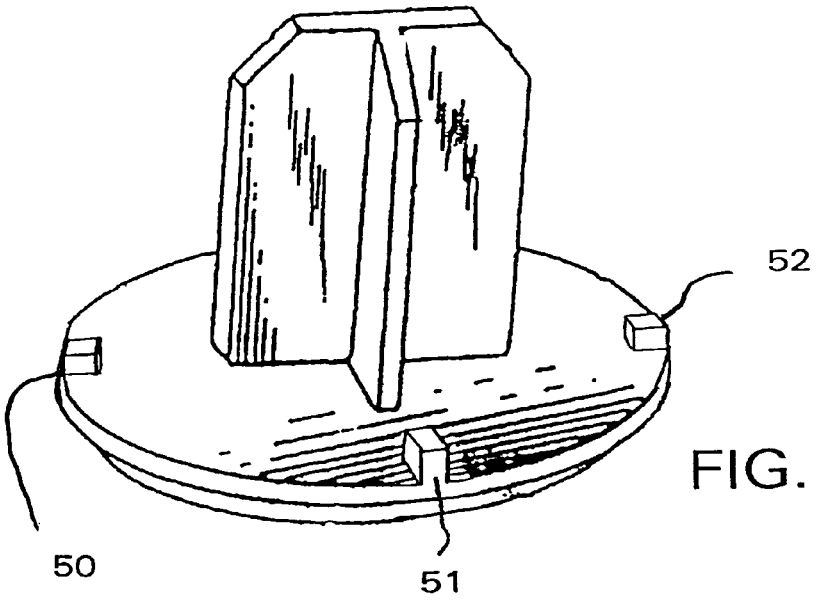
FIG. 9 is a perspective view of a variant of the plug of the present invention with projections to facilitate removal.
Figure 10:
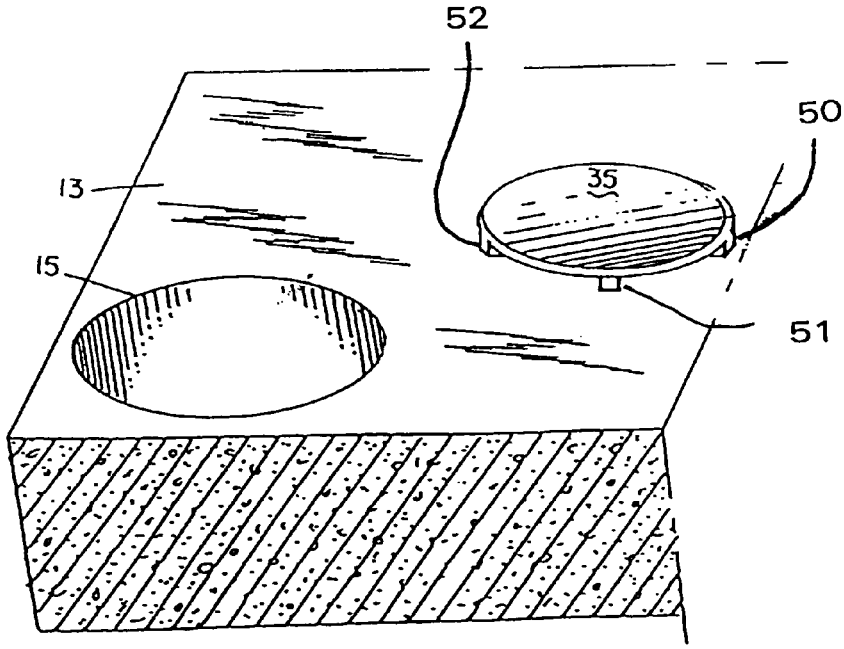
FIG. 10 shows the variant plug of FIG. 9 fully inserted in the hole and showing how the projections facilitate removal.

Referring to FIGS. 7 and 8, the head 32 also has an upper surface 35, a peripheral edge surface 36 and a peripheral beveled edge surface 39 at the upper end of the peripheral surface 36. Grooves or pry slots 37 and 38 are formed in the lower surface 34 and in the peripheral edge surface 36. In the preferred embodiment, there would be two grooves or slots, each on opposite sides of the head 32. The head 32 could also be provided with projections (50, 51, and 52 in FIGS. 9 and 10) that are spaced from the lower surface of the head to create apertures for enabling the plug to be pried from the hole. Preferably, the vanes would be radially tapered by tapers 45, 46, 47, and 48 from the center line of the plug toward the periphery of the head 32.

FIG. 7 shows the plug 31 of the present invention with the lower end of the base 33 placed in the two inch diameter hole. The insertion of the base and vanes into the hole is expedited by the taper of the lower end of the base and vanes. The diameter which is formed by the radial extension of the vanes forms a tight fit which is sufficient to keep the plug from accidentally becoming extracted from the hole. Although the diameter is preferably slightly larger than the diameter of the hole or the same as the diameter of the hole, it has been found that, even if the diameter of the vanes is slightly less than the diameter of the holes, as long as the longitudinal length of the base is at least equal to the diameter of the hole, the plug will not become accidentally extracted from the hole under normal construction conditions.

FIG. 8 shows the plug 31 of the present invention pressed fully into the two inch hole. The head 32 covers the hole and extends beyond the edge of the hole. Because the plug 31 is formed of high strength plastic, the head can be very thin and still possess the necessary strength. Thus, the head presents a very low and smooth edge profile on the floor and presents a minimal obstacle, especially because of the tapered upper edge. The pry slots 37 and 38 are engaged by a prying tool to extract the plug from the hole when desired.

The plug system shown in FIGS. 7 and 8 is, by example, for a construction base having a horizontal outer surface with vertical holes. The invention also extends to construction bases in which the outer surface is vertical or anything between vertical or horizontal. The terms "horizontal" and "vertical" as used in the specification and appended claims for the elements of the plug system are for relative orientation purposes only.

It is obvious that minor changes may be made in the form and construction of the invention without departing from the material spirit thereof. It is not, however, desired to confine the invention to the exact form herein shown and described, but it is desired to include all such as properly come within the scope claimed.

What is claimed is:

1. A plug for securely but removably covering a cylindrical hole of pre-determined, relatively large diameter in a floor or deck type building structure comprising:

(a) a head portion that has an upper surface, a flat lower surface and a peripheral edge surface;

(b) a base portion fixed to said lower surface and having a central vertical axis, said base portion having at least two diametrically opposed vanes, each of said vanes having an outer vertical edge surface that is spaced from said peripheral edge surface and extends perpendicularly from said lower surface to a lower edge, each of said vertical edge surfaces being parallel to said central axis and separated from the other vertical edge surface by a distance approximately equal to said diameter, each of said vanes having a tapered edge surface extending downwardly and inwardly from said lower edge; and (c) a recessed removal tool receiving element in said head portion and adapted to facilitate removal of the plug from the hole.

2. A plug as recited in claim 1, wherein said vanes are first and second vanes and said plug further comprises diametrically opposed third and fourth vanes that are substantially the same in configuration to and are transverse to said first and second vanes.

3. A plug as recited in claim 1, wherein said head portion has a peripheral beveled edge surface between said upper surface and said peripheral edge surface.

4. A plug as recited in claim 1, wherein said head portion is circular.

5. A plug as recited in claim 1, wherein said plug is made of a thermoplastic material.

6. A method of installing a plumbing/electrical fixture through a thick horizontal building structure having an upper surface, said method comprising:

(a) forming a cylindrical hole through said structure open at said upper surface;

(b) inserting a plug in the hole, the plug having a base portion that is inserted in the hole and configured to be held in the hole by a secure but reversible force fit, and having a head portion that covers the hole and extends beyond the edge of the hole for resting on said upper surface, the head portion being provided with a recessed removal tool receiving element adapted to facilitate removal of the plug from the hole;

(c) removing the plug from the hole and preserving the plug for re-use; and (d) inserting said fixture in the hole.

7. A plug for securely but removably covering a cylindrical hole of pre-determined, relatively large diameter in a floor or deck type building structure comprising:

(a) a head portion that has an upper surface, a flat lower surface and a peripheral edge surface;

(b) a base portion fixed to said lower surface and having a central vertical axis, said base portion having at least two diametrically opposed vanes, each of said vanes having an outer vertical edge surface that is spaced from said peripheral edge surface and extends perpendicularly from said lower surface to a lower edge, each of said vertical edge surfaces being parallel to said central axis and separated from the other vertical edge surface by a distance approximately equal to said diameter, each of said vanes having a tapered edge surface extending downwardly and inwardly from said lower edge; and (c) a gripping feature associated with said head portion and adapted to facilitate removal of the plug from the hole.

8. The plug as recited in claim 7, wherein said gripping feature is a pry slot extending from said peripheral edge surface toward said central axis.

9. The plug as recited in claim 8, wherein said pry slot is a first pry slot and said lower surface has a second pry slot extending from said peripheral edge surface toward said central axis and diametrically opposed to said first pry slot.

10. The plug as recited in claim 7, wherein said gripping feature is a at least one projection from said lower surface forming at least one removal tool receiving feature.

11. The plug as recited in claim 7, wherein said the distance separating the vertical edge surfaces is slightly less that the diameter of the hole but the lengths of the vertical edge surfaces are greater than the diameter of the hole.

* * * * *